US009061846B2

(12) United States Patent
Inoue

(10) Patent No.: US 9,061,846 B2
(45) Date of Patent: Jun. 23, 2015

(54) IMAGE FORMING APPARATUS

(71) Applicant: Canon Kabushiki Kaisha, Tokyo (JP)

(72) Inventor: Hiroshige Inoue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/231,467

(22) Filed: Mar. 31, 2014

(65) Prior Publication Data

US 2014/0291915 A1 Oct. 2, 2014

(30) Foreign Application Priority Data

Apr. 2, 2013 (JP) ..... 2013-076814

(51) Int. Cl.

| | |
|---|---|
| ***B65H 3/56*** | (2006.01) |
| ***B65H 3/06*** | (2006.01) |
| ***B65H 1/04*** | (2006.01) |
| ***B65H 9/00*** | (2006.01) |
| ***B65H 3/52*** | (2006.01) |
| ***B65H 5/06*** | (2006.01) |
| ***B65H 7/02*** | (2006.01) |

(52) U.S. Cl.

CPC .. *B65H 3/06* (2013.01); *B65H 1/04* (2013.01); *B65H 9/00* (2013.01); *B65H 3/56* (2013.01); *B65H 3/0607* (2013.01); *B65H 3/0669* (2013.01); *B65H 3/5261* (2013.01); *B65H 5/062* (2013.01); *B65H 7/02* (2013.01); *B65H 9/006* (2013.01); *B65H 2403/421* (2013.01); *B65H 2404/6111* (2013.01); *B65H 2405/1117* (2013.01); *B65H 2405/324* (2013.01); *B65H 2407/21* (2013.01); *B65H 2513/512* (2013.01); *B65H 2513/514* (2013.01); *B65H 2513/53* (2013.01); *B65H 2701/1311* (2013.01); *B65H 2801/06* (2013.01)

(58) Field of Classification Search

CPC .... B65H 2407/21; B65H 3/0607; B65H 3/56; B65H 9/006; B65H 9/08; B65H 2301/512125; B65H 2404/7231

USPC ..... 271/9.09, 242, 121, 125

See application file for complete search history.

(56) References Cited

U.S. PATENT DOCUMENTS

| | | | | |
|---|---|---|---|---|
| 8,480,082 | B2 * | 7/2013 | Kannari et al. | 271/242 |
| 2006/0180989 | A1 * | 8/2006 | Seike et al. | 271/121 |
| 2012/0008998 | A1 * | 1/2012 | Kannari et al. | 399/394 |

FOREIGN PATENT DOCUMENTS

| | | |
|---|---|---|
| JP | 11-343050 A | 12/1999 |

* cited by examiner

*Primary Examiner* — Michael McCullough

(74) *Attorney, Agent, or Firm* — Canon USA Inc. IP Division

(57) ABSTRACT

An image forming apparatus includes a registration roller pair, which is arranged on a downstream side in a sheet feeding direction with respect to a nip portion of a sheet feeding roller and a separation roller, configured to cause a leading edge of a sheet, the sheet is conveyed while being nipped by the sheet feeding roller and the separation roller, to abut against the stopped registration roller pair to form warping in the sheet. And, a backup sheet is deformed toward a separation roller side by abutting against the sheet, which has been warped by abutting the leading edge of the sheet against the registration roller pair, from the separation roller side in a vicinity of the downstream side in the sheet feeding direction with respect to the nip portion.

13 Claims, 12 Drawing Sheets

IMAGE FORMING APPARATUS

BACKGROUND OF THE INVENTION

1. Field of the Invention

The present invention relates to an image forming apparatus, and, in particular, to an image forming apparatus configured to correct skew of sheets by using a registration roller pair.

2. Description of the Related Art

Conventionally, in an image forming apparatus utilizing electrophotographic method configured to form an image on a sheet, such as a recording sheet, a toner image (visible image) borne by a photosensitive drum or a transfer member is transferred to a sheet, such as plain paper, fed by a sheet feeding device thereby obtaining an image. In such a conventional image forming apparatus, during feeding operation in which the sheet is fed by the sheet feeding device, or during sheet conveyance thereafter, skew of a sheet to the sheet feeding direction may occur. When the skew of a sheet occurs, an image is formed on the sheet in a tilting manner to the sheet direction through transfer and fixing steps.

Therefore, in the conventional image forming apparatus, a skew correction unit is provided on the upstream side of the image forming unit, and skew of the sheet is corrected by this skew feed correction unit. With the skew correction unit, accuracy of an image forming position is improved. Such a skew correction unit causes the leading edge of the conveyed sheet to abut against the nip of a stopped registration roller pair and thereby, the sheet is warped. Consequently, the sheet leading edge is aligned in the direction orthogonal to the sheet feeding direction.

Conventionally, between the sheet feeding device and the registration roller pair, there is arranged a conveyance roller for conveying the sheet fed from a sheet feeding roller of the sheet feeding device to the registration roller pair. However, to achieve a reduction in the size of the apparatus as a whole, there has been proposed an image forming apparatus in which, instead of providing the conveyance roller, the registration roller pair is arranged directly downstream the sheet feeding roller of the sheet feeding device. This technique is discussed, for example, in Japanese Patent Application Laid-Open No. 11-343050.

FIG. 10 is a diagram illustrating an example of a conventional image forming apparatus. Sheets S fed by a sheet feeding roller 51 are fed while being separated one by one by a separation roller 53, which is brought into press contact with the sheet feeding roller 51 by a pressure spring 56. The sheet S fed by the sheet feeding roller 51 is conveyed toward the nip portion of a stopped registration roller pair 57. Then, the leading edge of the sheet S abuts against the nip portion to form a warp in the sheet S. In this way, skew of the sheet leading edge is corrected. After the formation of the warp in the sheet S, the registration roller pair 57 is rotated by an image leading edge synchronization signal. Then, the skew of the entire sheet S is corrected before the sheet S is conveyed to the image forming unit.

In the conventional image forming apparatus, when conveying a sheet of high rigidity, such as an envelope or a postcard, slipping may occur between the sheet feeding roller 51 and the sheet S when rotating the registration roller pair 57 after the formation of the warp in the sheet S. Consequently, defective conveyance of the sheet S may occur.

The above described issue may be caused by the reason that, when the leading edge of the sheet S abuts against the nip portion of the stopped registration roller pair 57 to form the warp in the sheet S, the separation roller 53 is pressed down away from the sheet feeding roller 51 as indicated by the arrow A illustrated in FIG. 10. When the separation roller 53 is pressed down, the press contact force between the sheet S and the sheet feeding roller 51 is weakened. Therefore, the required conveyance force by the sheet feeding roller 51 for conveying the sheet S cannot be obtained. As a result, the leading edge of the sheet S cannot enter the nip portion of the registration roller pair 57, and the conveyance of the sheet S is suspended.

SUMMARY OF THE INVENTION

The present invention, which has been made in view of the above issue, is directed to an image forming apparatus capable of obtaining the required conveyance force also for a sheet of high rigidity.

According to an aspect of the present invention, an image forming apparatus includes an image forming unit configured to form an image on a sheet, a sheet stacking unit on which sheets are stacked, a sheet feeding unit configured to feed the sheets stacked on the sheet stacking unit, a separation unit held in press contact with the sheet feeding unit and configured to separate the sheets fed from the sheet feeding unit, a registration unit, which is arranged on a downstream side in a sheet feeding direction with respect to a press contact portion where the sheet feeding unit and the separation unit are held in press contact with each other, configured to abut, while being at rest, against the leading edge of the sheet, which is conveyed while being nipped by the sheet feeding unit and the separation unit, and to convey the sheet to the image forming unit by rotating at a predetermined timing, and a plate-like elastic member capable of elastic deformation and configured to abut against the sheet, which is warped as a result of abutting against the registration unit from a separation unit side on the downstream side in the sheet feeding direction with respect to the press contact portion.

According to another aspect of the present invention, an image forming apparatus includes an image forming unit configured to form an image on a sheet, a sheet stacking unit on which sheets are stacked, a sheet feeding roller configured to feed the sheets stacked on the sheet stacking unit, a separation unit held in press contact with the sheet feeding roller and having an axial length smaller than the sheet feeding roller, a registration unit, against which a leading edge of the sheet abuts, the sheet being conveyed while being nipped at a press contact portion between the sheet feeding roller and the separation unit, configured to start conveyance with a predetermined timing, and a plate-like elastic member capable of elastic deformation arranged on both sides of the press contact portion between the sheet feeding roller and the separation unit, extending from an upstream side to a downstream side in a sheet feeding direction, and capable of being brought into press contact with a peripheral surface of the sheet feeding roller.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

Figure 1:
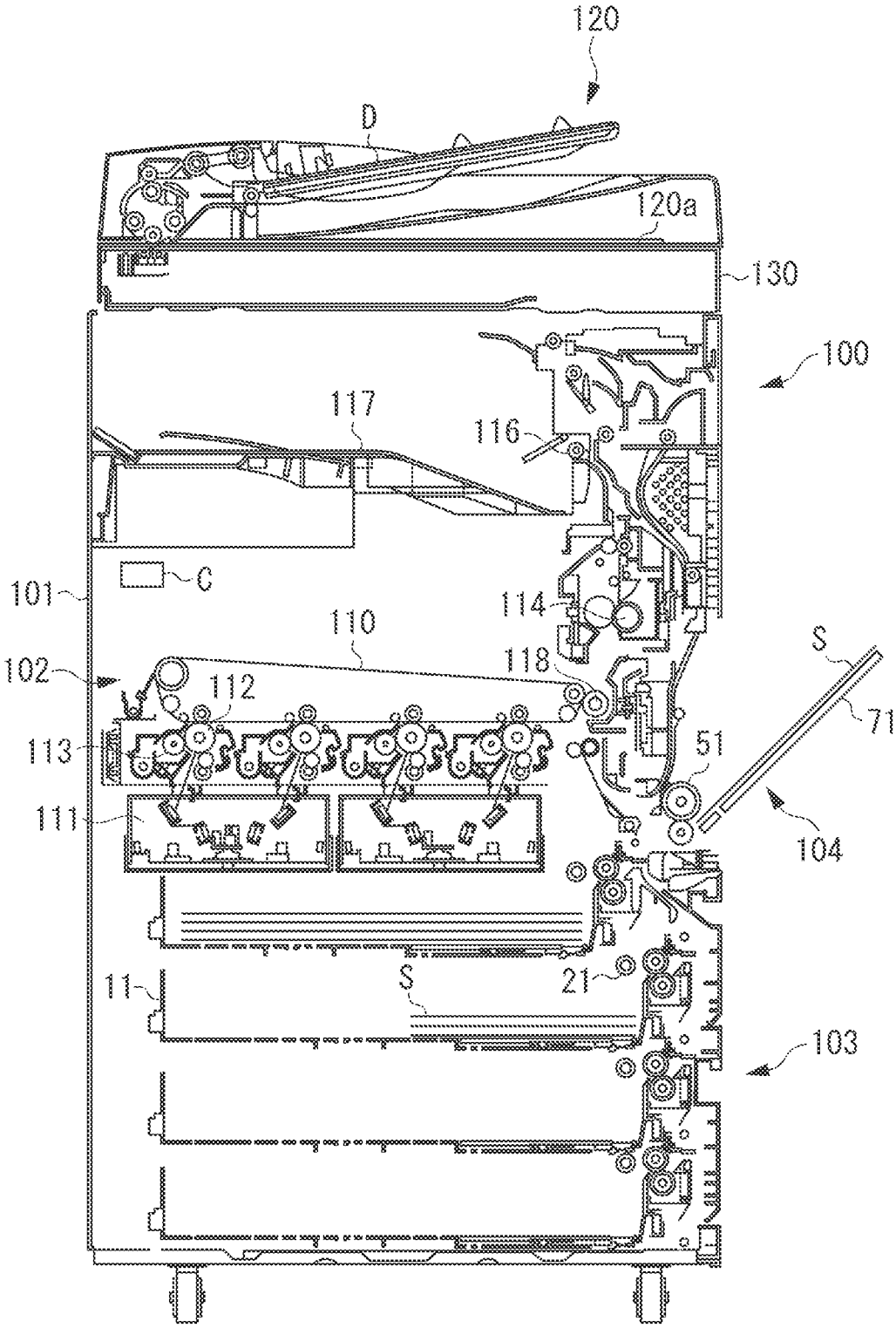
FIG. 1 is a schematic diagram illustrating a configuration of a printer as an example of an image forming apparatus according to an exemplary embodiment of the present invention.

FIG. 1 is a schematic diagram illustrating a configuration of a printer as an example of an image forming apparatus according to an exemplary embodiment of the present invention.

In FIG. 1, a printer 100 includes a printer main body 101. In the upper portion of this printer main body 101, an image reading unit 130 is provided as a document positioning table of an automatic document feeder 120. The image reading unit 130 is configured to read a document D placed on a platen glass 120*a*. Below the image reading unit 130, an image forming unit 102, a sheet feeding device 103 configured to feed sheets S to the image forming unit 102, and a manual sheet feeding unit 104 are provided.

The image forming unit 102 includes a laser scanner unit 111, a photosensitive drum 112, a developing device 113, and other components. The sheet feeding device 103 includes a plurality of sheet storage units 11, a pickup roller 21, and the like. The sheet storage units 11 are configured to store the sheets S and detachably mounted on the printer main body 101. The pickup roller 21 as a sheet feeding unit is configured to feed the sheets S stored in the sheet storage units 11.

The manual sheet feeding unit 104 is provided on a side surface of the printer main body 101 as the apparatus main body so as to be openable and closable. The manual sheet feeding unit 104 includes a sheet feeding tray 71 on which the sheets S are stacked, a sheet feeding roller 51 as a sheet feeding unit configured to feed the sheets S stacked on the sheet feeding tray 71, and the like. When using the manual sheet feeding unit 104, the sheet feeding tray 71 is opened to protrude it to a position where sheet conveyance is possible, and a user sets the desired sheet on the sheet feeding tray 71. A control unit C is provided in the printer main body 101.

Next, the image forming operation of the printer 100, which has the configuration described above, will be described. When an image reading signal is output to the image reading unit 130 from the control unit C provided in the printer main body 101, an image is read by the image reading unit 130. After this, laser light corresponding to this electric signal is applied to the photosensitive drum 112 from the laser scanner unit 111.

At this time, the photosensitive drum 112 has previously been charged, and an electrostatic latent image is formed on the photosensitive drum 112 through the application of light to the photosensitive drum 112. Subsequently, the electrostatic latent image is developed by the developing device 113. Then, a toner image is formed on the photosensitive drum 112. The toner image thus formed is primarily transferred to the outer periphery of an intermediate transfer belt 110. Thus, a toner image is formed on the intermediate transfer belt 110.

When a sheet feeding signal is output from the control unit C to the sheet feeding device 103, a sheet S is fed by the pickup roller 21 from the sheet storage unit 11 as the sheet storage portion. When the sheet feeding signal is output from the control unit C to the manual sheet feeding unit 104, the sheet S is fed by the sheet feeding roller 51 from the sheet feeding tray 71 as the sheet storage portion. Then, skew of the sheet S is corrected by a registration roller pair 57, and then the sheet S is conveyed to a transfer unit formed by the intermediate transfer belt 110 and a secondary transfer roller 118 in synchronization with the toner image on the intermediate transfer belt 110.

The toner image is transferred to the sheet S conveyed to the transfer unit. Then, the sheet S is conveyed to a fixing unit 114. By being heated and pressed by the fixing unit 114, the unfixed transfer image is permanently fixed to the sheet S. The sheet S with the image fixed thereto is discharged from the printer main body 101 to a discharge tray 117 by a discharge roller 116.

Figure 2:
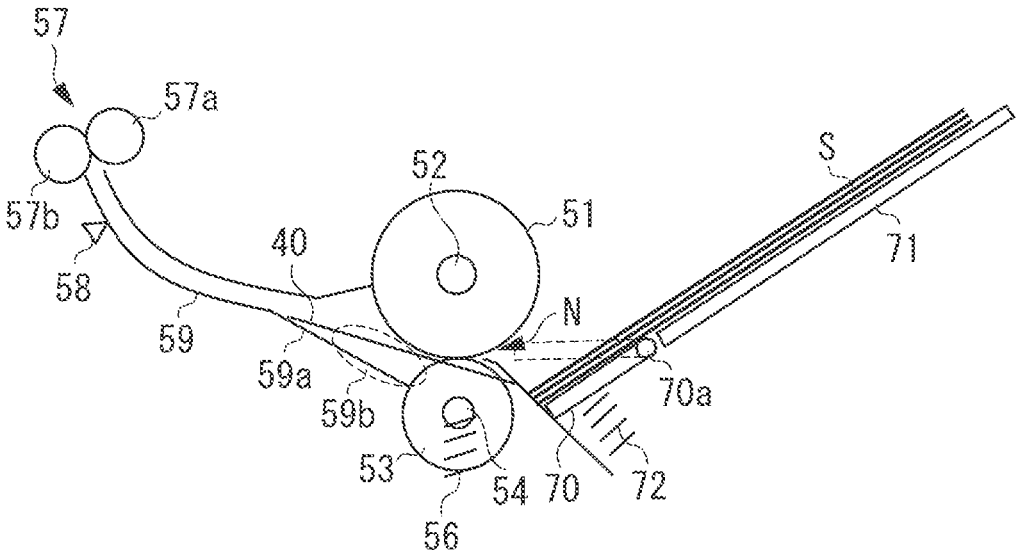
FIG. 2 is a diagram illustrating a configuration of a manual sheet feeding unit provided in the printer.

FIG. 2 is a diagram illustrating a configuration of the manual sheet feeding unit 104. A middle plate 70 is provided on the sheet feeding tray 71 as a sheet stacking unit on which sheets S are stacked. The mille plate 70 serves as a pressure member provided so as to be vertically rotatable around a fulcrum 70*a*. A pressure spring 72 serving as a pressure unit applies pressure to the middle plate 70 in the clockwise direction (in the direction in which the sheet S is pressed against the sheet feeding roller 51) as illustrated in the FIG. 2. This middle plate 70 is moved by a pressure separation unit described below to a position indicated by the dashed line where the sheet S is brought into press contact with the sheet feeding roller 51 as the sheet feeding unit, and to a position indicated by the solid line where the press contact of the sheet S with the sheet feeding roller 51 is released.

A separation roller 53 (retard roller) as a separation unit is held in press contact with the sheet feeding roller 51. The axial length of the separation roller 53 is set to be shorter than that of the sheet feeding roller 51 (See FIG. 3). A sheet conveyance path 59 is provided on the downstream side of the nip portion N as the press contact portion between the sheet feeding roller 51 and the separation roller 53. The upstream side of a conveyance lower guide 59*a*, which constitutes the sheet conveyance path 59, in the sheet feeding direction is downwardly tilted. A guide space 59*b* for delivery of a warped sheet is formed on the downstream side in the sheet feeding direction of the nip portion N.

A registration roller pair 57 is provided in the sheet conveyance path 59 to form an image at the proper position of the sheet S. The registration roller pair 57 is configured to feed the sheet S to an image forming unit 102 at a predetermined timing. The leading edge of the sheet S, which is conveyed while being nipped by the sheet feeding roller 51 and the separation roller 53, abuts against the nip portion of the registration roller pair 57, which is in the rotation stopped state. Therefore, the sheet S is warped for correcting the skew of the sheet S. On the upstream side of the registration roller pair 57 as a registration unit, a pre-registration sensor 58 as a detection unit is provided. The pre-registration sensor 58 is configured to detect the leading edge of the sheet S.

The sheet conveyance path 59 has a curved-shape for guiding the sheet S to be conveyed while being nipped by the sheet feeding roller 51 and the separation roller 53, to the registration roller pair 57. The distance from the sheet feeding roller 51 to the registration roller pair 57 along the sheet conveyance path 59 is set to be shorter than the minimum size of a sheet usable in the printer 100, in the feeding direction. By curving this sheet conveyance path 59 and by not providing any conveyance roller between the sheet feeding roller 51 and the registration roller pair 57, a reduction in the size of the apparatus is achieved.

Figure 3:
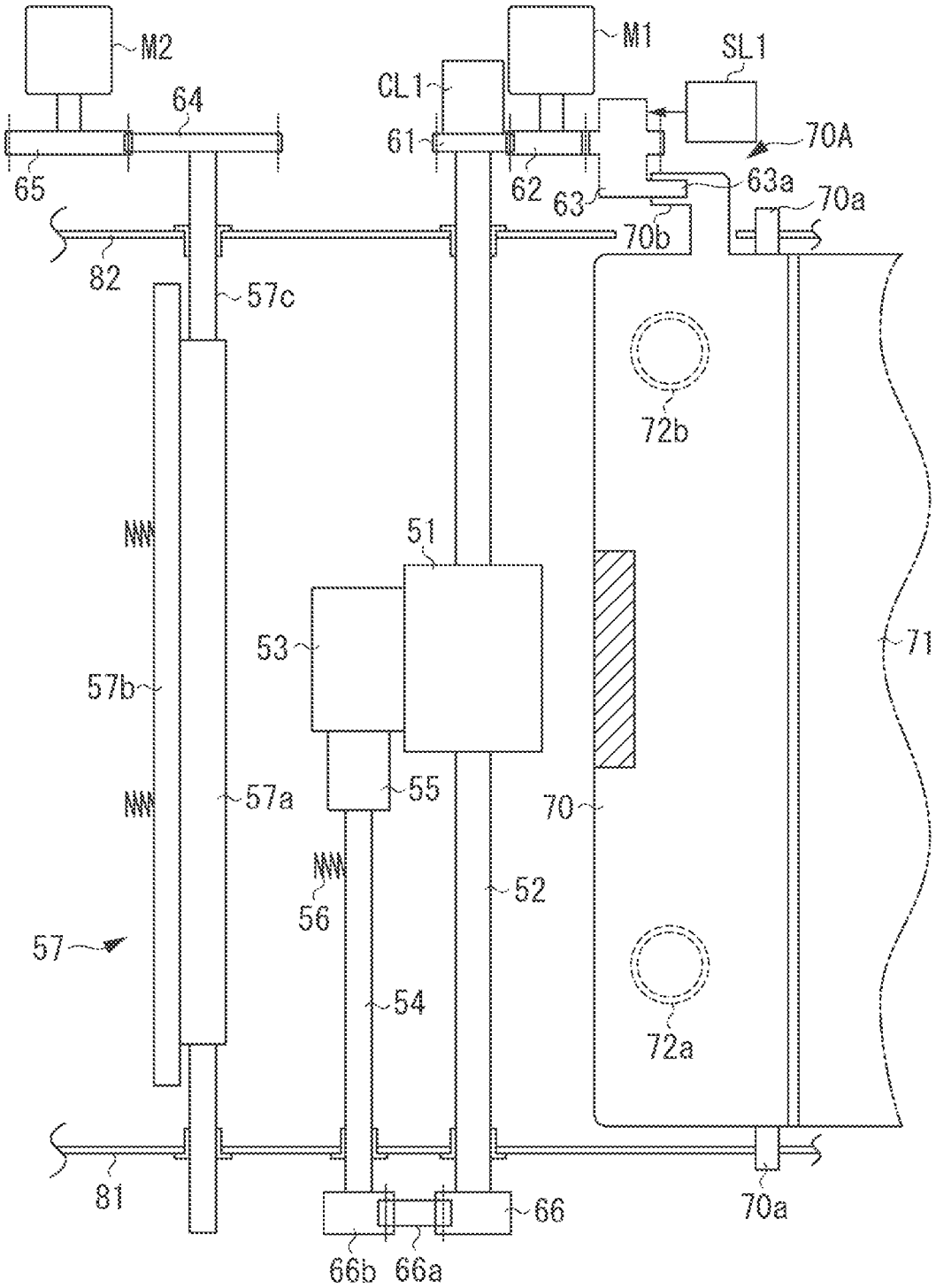
FIG. 3 is a diagram illustrating a drive mechanism of the manual sheet feeding unit.

FIG. 3 is a developed view illustrating the drive mechanism of the manual sheet feeding unit 104. As illustrated in FIG. 3, the sheet feeding roller 51 is fixed to a support shaft 52, and the support shaft 52 is rotatably supported by a front side plate 81 and a rear side plate 82. An electromagnetic clutch CL1 is provided at the depth side end portion of the support shaft 52, and driving force from a sheet feeding motor M1 transmitted via gears 61 and 62 is selectively transmitted to the support shaft 52 by this electromagnetic clutch CL1.

A gear 66 is fixed to the support shaft 52 of the sheet feeding roller 51, and driving force is transmitted to a separation roller drive shaft 54 via gears 66*a* and 66*b*, which are configured to transmit the rotation of the gear 66.

The separation roller drive shaft 54 is provided with a separation roller 53 via a torque limiter 55. The separation roller drive shaft 54 is configured to transmit torque of a predetermined value or less. The separation roller 53 is provided so as to be contactable with and separatable from the sheet feeding roller 51. The separation roller 53 is configured to be brought into press contact with the sheet feeding roller 51 with a predetermined separation pressure by a pressure spring 56 via a bearing (not illustrated). The rotation transmitted to the separation roller drive shaft 54 by the gears 66*a* and 66*b* rotates the separation roller 53 so as to feed back the sheet S to the upstream side in the sheet feeding direction. In other words, driving force is transmitted from the separation roller drive shaft 54 to the separation roller 53 for reversing the separation roller 53 to feed back the sheet S in a direction opposite to the sheet feeding direction.

The torque value of the torque limiter 55 and the spring force of the pressure spring 56 are set so that a feeding-back force for feeding back the sheets S is generated by reverse rotation of the separation roller 53 only when two or more sheets S are nipped at the nip portion N. Further, the torque value of the torque limiter 55 and the spring force of the pressure spring 56 are set such that the separation roller 53 follows the sheet feeding roller 51 by the frictional force generated between itself and the sheet S or between itself and the sheet feeding roller 51, in a state in which only one sheet or no sheet is nipped at the nip portion N of the sheet feeding roller 51 and the separation roller 53.

A gear 62 configured to be rotated by the driving force from the sheet feeding motor M1 is provided so as to be meshable with a partially toothed gear 63. And, the partially toothed gear 63 is integrally provided with a cam 63*a* as a pressure separation unit for bringing the sheet S supported by the middle plate 70 into and out of press contact with the sheet feeding roller 51. The partially toothed gear 63 is regulated in position by a solenoid SL1 such that the untoothed portion faces the gear 62 until the feeding of the sheet S is started. When the partially toothed gear 63 is at this regulated position, a lock portion 70*b* provided on the middle plate 70 is pressed down by the cam 63*a*, and the sheet S on the middle plate 70 is separated from the sheet feeding roller 51.

When starting the feeding of the sheet S, the solenoid SL1 is turned on, and the partially toothed gear 63 and the gear 62 are meshed with each other to transmit rotational force. Then, the cam 63*a* is separated from the middle plate 70. As a result, the middle plate 70 is pushed upwards by pressure springs 72 (72*a* and 72*b*), and the sheet S is brought into press contact with the sheet feeding roller 51. According to the present exemplary embodiment, a moving unit 70A configured to move the middle plate 70, which is elevatable, is formed by the cam 63*a* and the pressure springs 72.

When the cam 63*a* performs one rotation, the middle plate 70 is pressed down again, and the sheet S and the sheet feeding roller 51 are separated from each other. In this way, the partially toothed gear 63 is controlled to perform one-rotation so that the press contact between the sheet S and the sheet feeding roller 51 is released, effected, and released again.

Further, as described above, on the downstream side in the sheet feeding direction of the sheet feeding roller 51, the registration roller pair 57 including a driving roller 57*a* and a driven roller 57*b* is provided. The driving rollers 57*a* and the driven roller 57*b* are configured to feed the sheet S to the image forming unit in a timed manner. The drive shaft 57*c* of a driving roller 57*a* is rotatably supported by the front side plate 81 and the rear side plate 82, and the driving force of a registration motor M2 is transmitted via gears 64 and 65. The driven roller 57*b* is held in press contact with the driving roller 57*a* by a spring.

Figure 4:
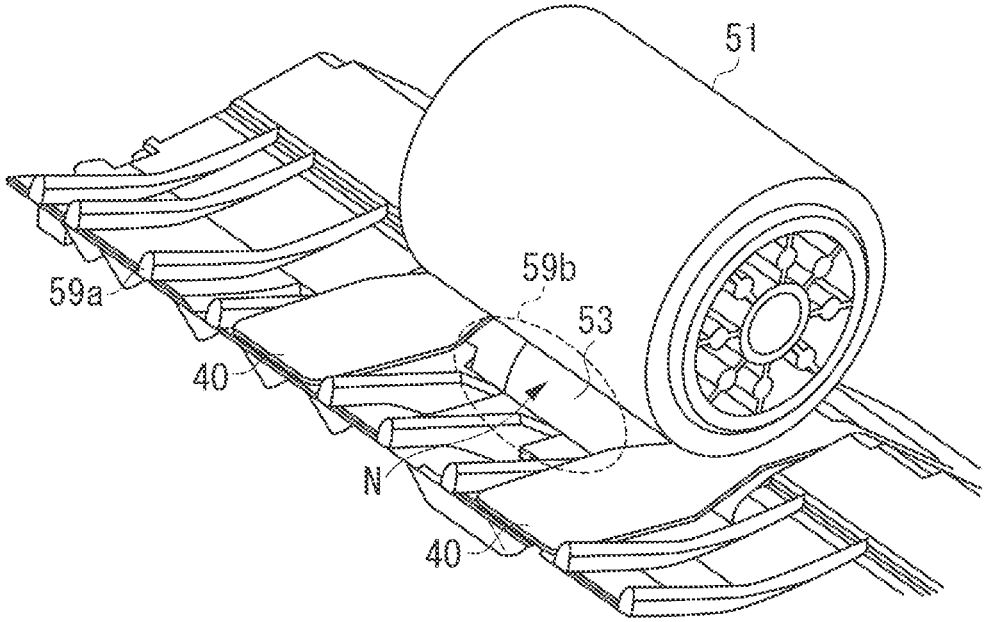
FIG. 4 is a first diagram illustrating a backup sheet provided in the manual sheet feeding unit.

As illustrated in FIG. 4, below the nip portion N of the sheet feeding roller 51 and the separation roller 53, a backup sheet 40 is arranged so as to cover the guide space 59*b* from the upstream side to the downstream side of the nip portion N. The backup sheet 40 is a plate-like elastic member capable of elastic deformation. The backup sheet 40 is arranged such that the downstream end thereof in the sheet feeding direction is situated on the downstream side in the sheet feeding direction of the nip portion and the upstream end thereof in the sheet feeding direction is situated on the upstream side in the sheet feeding direction of the nip portion N. The backup sheet 40 is arranged so as to be capable of being brought into press contact with the peripheral surface of the sheet feeding roller 51 on both sides of the separation roller 53.

As described below, the backup sheet 40 is arranged so as to abut against the sheet S being fed in the vicinity of the downstream side in the sheet feeding direction of the nip portion N from the separation roller 53 side (the separation unit side). When the sheet S is warped downwardly, the backup sheet 40 can be deformed toward the separation roller 53 side. Due to the reaction force when the backup sheet 40 is deformed in the vicinity of the downstream side in the sheet feeding direction of the nip portion N, the force, by which the separation roller 53 is pressed down away from the sheet feeding roller 51, is reduced due to the rigidity of the sheet S.

Figure 5A:
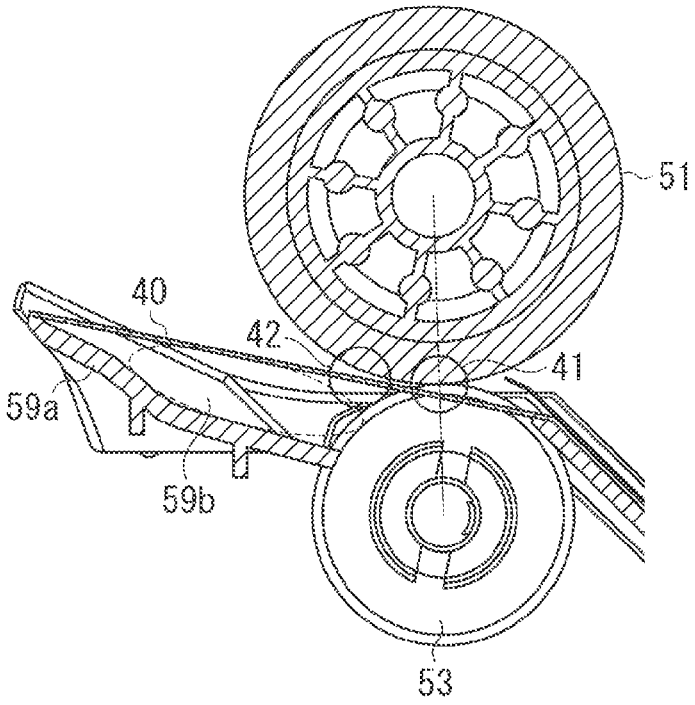
FIGS. 5A and 5B are second diagrams illustrating the backup sheet.

As illustrated in FIG. 5A, the backup sheet 40 is provided such that the upstream side thereof in the sheet feeding direction is inclined toward the separation roller 53 side with respect to the tangential direction of the nip portion N of the sheet feeding roller 51 and the separation roller 53. As a result, the distance between the backup sheet 40 and the sheet feeding roller 51 is determined as follows: the distance between the backup sheet 40 and the sheet feeding roller 51 as measured vertically from the nip portion N, indicated by numeral 41 in FIG. 5A, is longer than the distance between the sheet feeding roller 51 and the backup sheet 40 as measured from a portion of the backup sheet on the downstream side in the sheet feeding direction of the nip portion, indicated by numeral 42.

Figure 5B:
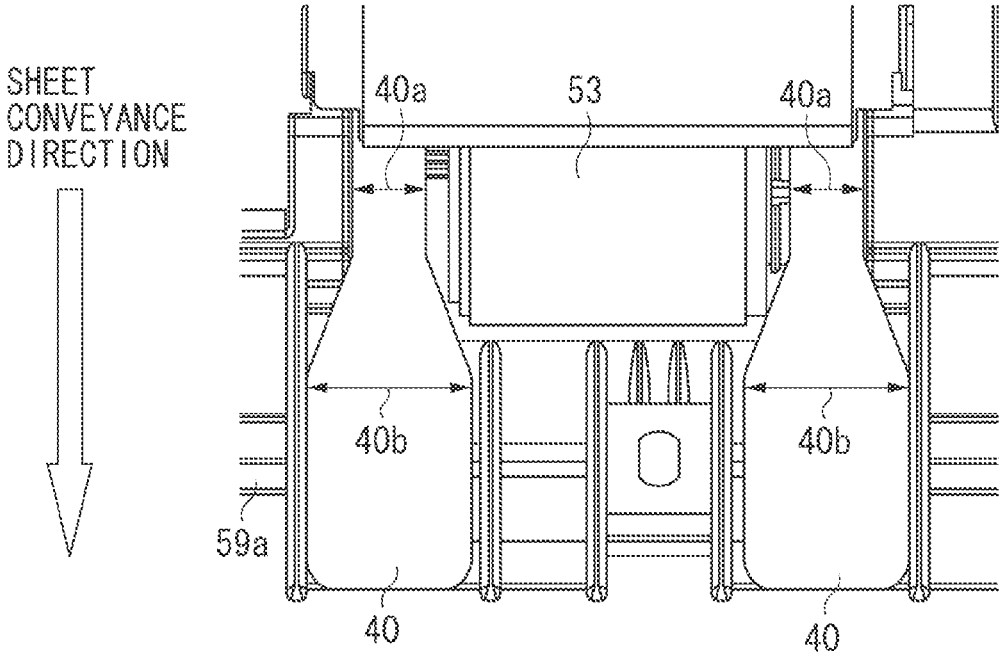

As illustrated in FIG. 5B, a pair of the backup sheets 40 is arranged so as to overlap the sheet feeding roller 51, that is, on both sides in the width direction orthogonal to the sheet feeding direction of the separation roller 53 below the sheet feeding roller 51. Further, regarding the width of the backup sheet 40, the width 40*b* of the portion thereof on the downstream side in the sheet feeding direction is larger than the width 40*a* of the portion thereof on the upstream side in the sheet feeding direction.

Here, as described above, the backup sheet 40 is provided such that the upstream side thereof in the sheet feeding direction is inclined to the separation roller 53 side. Therefore, the distance between the backup sheet and the sheet feeding roller 51 is elongated on the upstream side of the nip portion N. Thus, even a plurality of sheets S is double fed and enters the nip portion N, the sheets S are not easily brought into contact with the backup sheet 40. Further, by reducing the width 40*a* of the portion on the upstream side in the sheet feeding direction, force pushing up the sheet S toward the sheet feeding roller 51 side by the backup sheet 40 is small even when the leading edge of the sheet S is forced-in to the separation roller 53 side by the conveyance force of the sheet feeding roller 51 and the middle plate 70.

As a result, even when a plurality of sheets is double fed and enters the nip portion N, conveyance force is not easily generated between the sheet feeding roller 51 and the sheet S. As a result, even when the sheets S double-fed greatly overrun, conveyance force is not abruptly generated between the double-fed sheets and the sheet feeding roller 51. Therefore, the feeding back effect on the double-fed sheets is not blocked.

As described above, on the downstream side of the nip portion N, the distance between the backup sheet 40 and the sheet feeding roller 51 is short. Therefore, the trailing edge of the sheet S having a warp formed by abutting against the registration roller pair 57 becomes likely to abut against the backup sheet 40. Further, the width of the portion of the backup sheet 40 on the downstream side in the sheet feeding direction is large. Therefore, when the sheet S having formed a warp abuts against the backup sheet 40, the backup sheet 40 is not greatly pressed down away from the sheet feeding roller 51 due to the rigidity of the sheet S. And, with the arrangement in which the backup sheet 40 is not greatly pushed down even when the sheet S having a warp abuts against the backup sheet 40, it is possible to prevent the separation roller 53 from being pressed down away from the sheet feeding roller 51 due to the rigidity of the sheet S.

Figure 6:
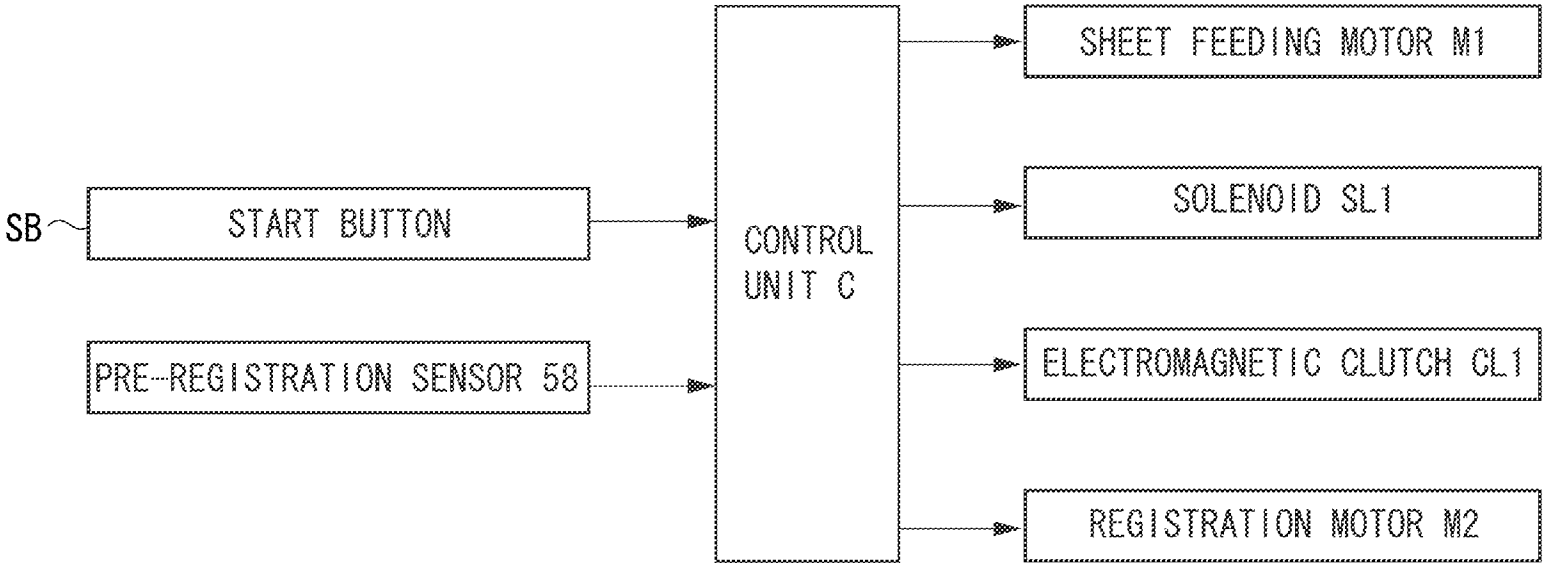
FIG. 6 is a block diagram illustrating control of the manual sheet feeding unit.

FIG. 6 is a block diagram illustrating control of the manual sheet feeding unit 104 according to the present exemplary embodiment. The control unit C includes a central processing unit (CPU), read-only memory (ROM), and random-access memory (RAM) (not illustrated). As illustrated in FIG. 6, a signal from a start button SB and a detection signal of the pre-registration sensor 58 are input to the control unit C. Based on these signals, the control unit C controls each of the sheet feeding motor M1, the solenoid SL1, the electromagnetic clutch CL1, and the registration motor M2.

Figure 7:
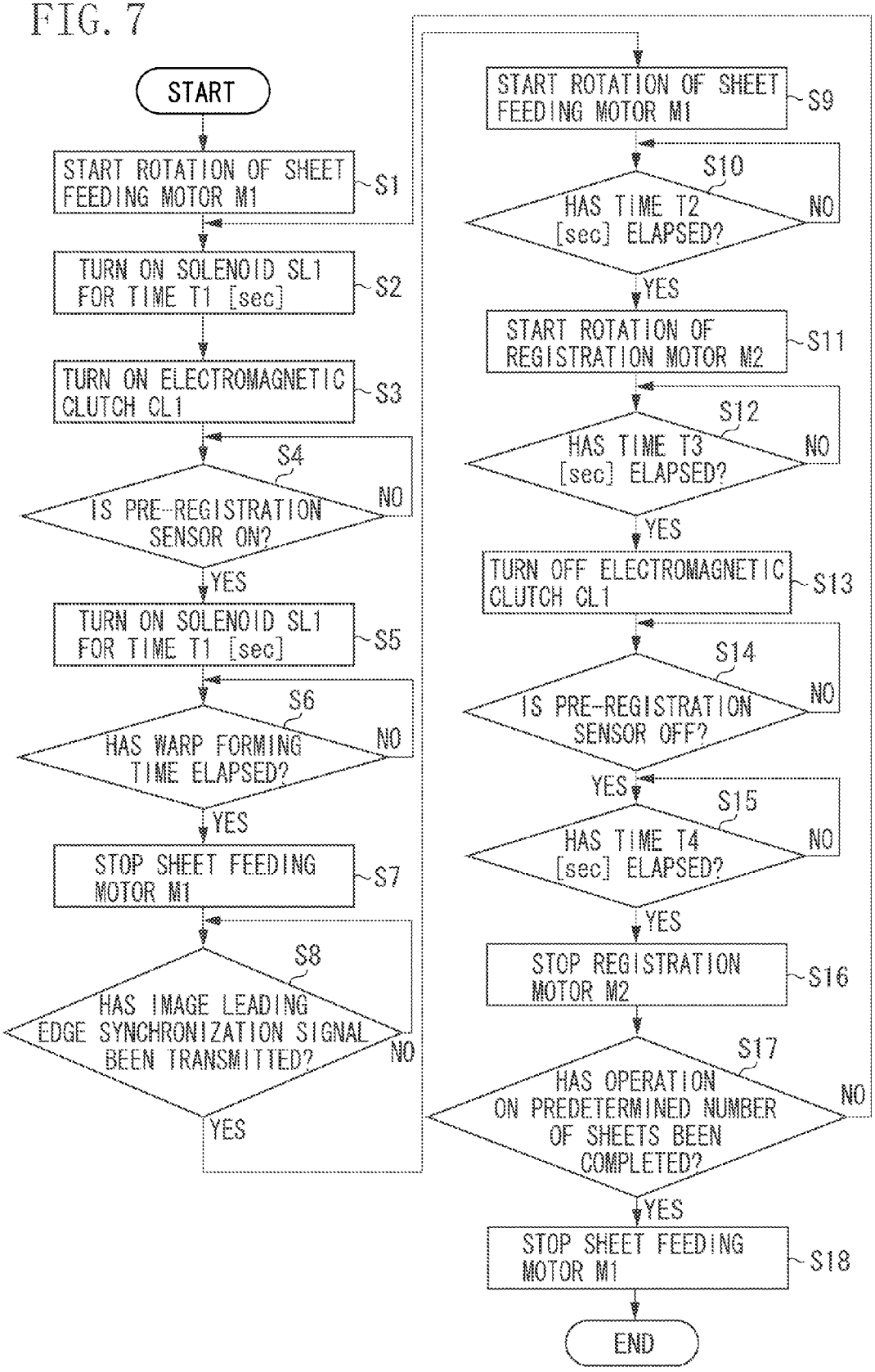
FIG. 7 is a flowchart illustrating a sheet feeding operation of the manual sheet feeding unit.

Next, the sheet feeding operation of the manual sheet feeding unit 104 is described with reference to the flowchart illustrated in FIG. 7 and diagrams illustrated in FIGS. 8A through 8J.

Figure 8A:
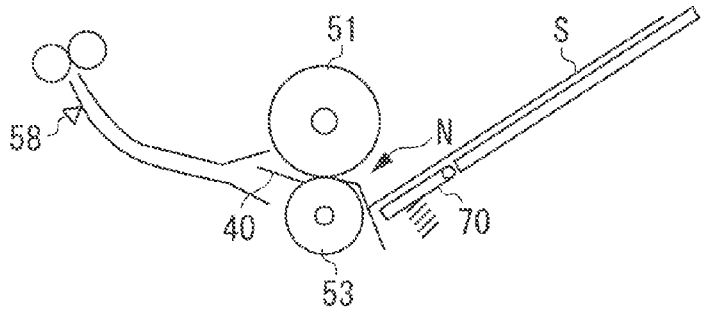
FIGS. 8A, 8B, 8C, 8D, 8E, 8F, 8G, 8H, 8I, and 8J are diagrams each illustrating the sheet feeding operation of the manual sheet feeding unit.
Figure 8B:
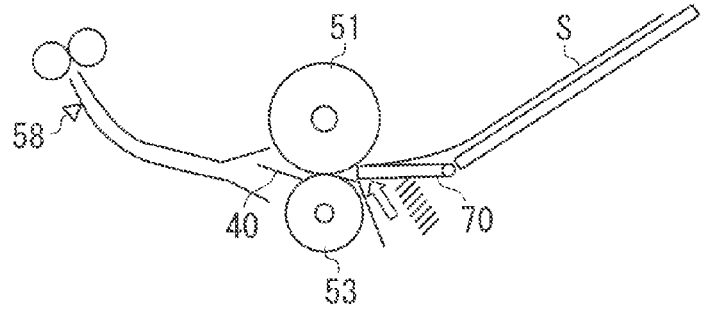

In step S1, in the initial state illustrated in FIG. 8A, when the start button SB is depressed, the control unit C starts the rotation of the sheet feeding motor M1. Next, in step S2, the control unit C turns on the solenoid SL1 for time T1 [sec], and one-rotation control is started on the partially toothed gear 63 and on the cam 63*a* provided on the partially toothed gear 63. Through this operation, the middle plate 70 is raised as illustrated in FIG. 8B, and the sheet S supported by the middle plate 70 is brought into press contact with the sheet feeding roller 51.

Figure 8C:
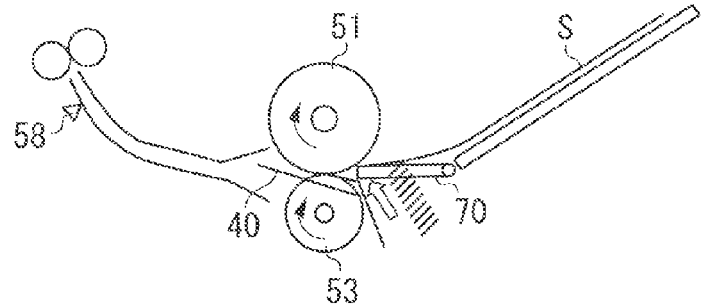
Figure 8D:
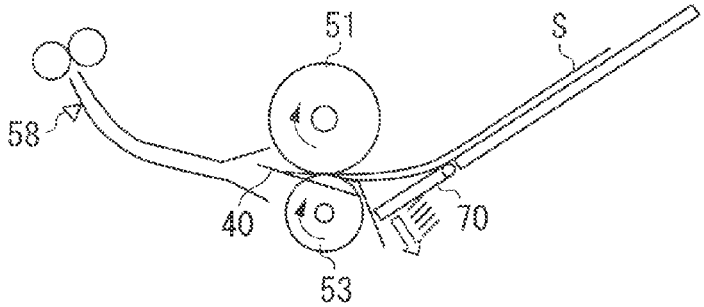

When the sheet S is brought into press contact with the sheet feeding roller 51, in step S3, the control unit C turns on the electromagnetic clutch CL1. Then, the control unit C rotates the sheet feeding roller 51. As a result, as illustrated in FIG. 8C, the feeding of the sheet S is started. As illustrated in FIG. 8D, at the ending stage of the one-rotation control, the middle plate 70 is pressed down by the cam 63*a*, and the press contact of the sheet S with the sheet feeding roller 51 is released. According to the present exemplary embodiment, the number of teeth of the partially toothed gear 63 and the configuration of the cam 63*a* are determined such that the press contact of the sheet S with the sheet feeding roller 51 due to the middle plate 70 is released immediately after the sheet S has entered the nip portion (press contact portion) N of the sheet feeding roller 51 and the separation roller 53.

Figure 8E:
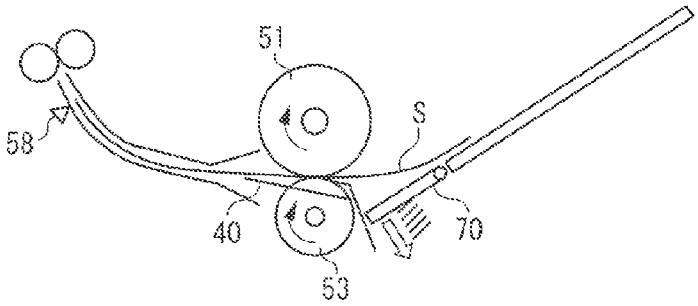

Next, as illustrated in FIG. 8E, when the pre-registration sensor 58 detects the leading edge of the sheet S conveyed by the sheet feeding roller 51 (YES in step S4), in step S5, the control unit C turns on the solenoid SL1 for a predetermined time T1 [sec]. Consequently, the rotation of the sheet feeding motor M1 is transmitted to the partially toothed gear 63, and the cam 63*a* rotates. As a result, the pressing-down by the cam 63*a* is released, and the middle plate 70 ascends. Then, the sheet S stacked on the middle plate 70 is brought into press contact with the sheet feeding roller 51.

Figure 8F:
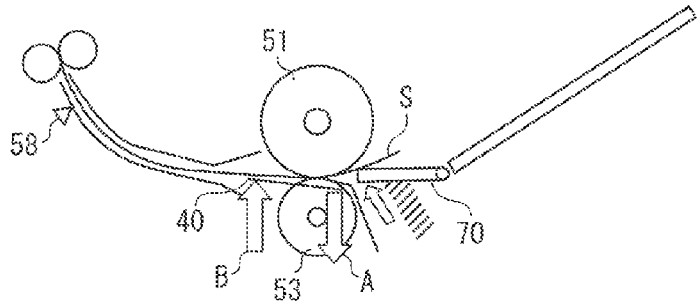

After the detection of the leading edge of the sheet S by the pre-registration sensor 58, the sheet feeding roller 51 is rotated until a predetermined period of time has elapsed. Therefore, the sheet S is fed even after the leading edge of the sheet S abuts against the nip portion of the stopped registration roller pair 57. As a result, a proper warp is formed in the sheet S on the upstream side of the registration roller pair 57. When the predetermined period of time for forming this warp has elapsed (YES in step S6), in step S7, the feeding of the sheet S by the sheet feeding roller 51 is stopped as illustrated in FIG. 8F.

The timing of turning on the solenoid SL1 is set as follows: the timing at which the solenoid SL1 is turned on and the sheet S on the middle plate 70 abuts against the sheet feeding roller 51, and the timing at which the proper warp is formed in the sheet S and the sheet feeding roller 51 is stopped, become substantially the same. By setting the timing as described above, at the start of the rotation of the registration motor M2, the sheet S is held in press contact with the sheet feeding roller 51 by the middle plate 70.

As a result, before the driving of the registration roller pair 57 is started, the sheet feeding roller 51 is stopped with the sheet S being held in press contact with the sheet feeding roller 51 by the middle plate 70. That is, before the start of the driving of the registration roller pair 57, the sheet S is held in press contact with the sheet feeding roller 51 at two nip portions, i.e., the nip portion of the sheet feeding roller 51 and the middle plate 70, and the nip portion of the sheet feeding roller 51 and the separation roller 53. As a result, the sheet feeding force due to the sheet feeding roller 51 is secured. Therefore, even in the case of the configuration according to the present exemplary embodiment in which the sheet S is pressed against the registration roller pair 57 by the sheet feeding roller 51, it is possible to securely press the sheet S against the registration roller pair 57.

Figure 8G:
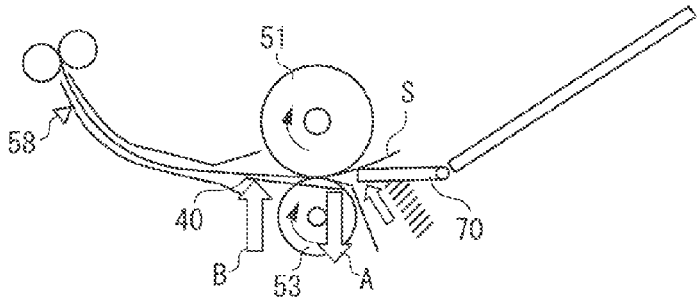

When an image leading edge synchronization signal is transmitted by the secondary transfer roller 118 or the laser scanner unit 111 (YES in step S8), in step S9, the control unit C starts the rotation of the sheet feeding motor M1. Then, the rotation of the sheet feeding roller 51 is started as illustrated in FIG. 8G. As a result, the feeding of the sheet S is resumed, and the leading edge of the sheet S securely abuts against the nip portion of the registration roller pair 57.

Figure 8H:
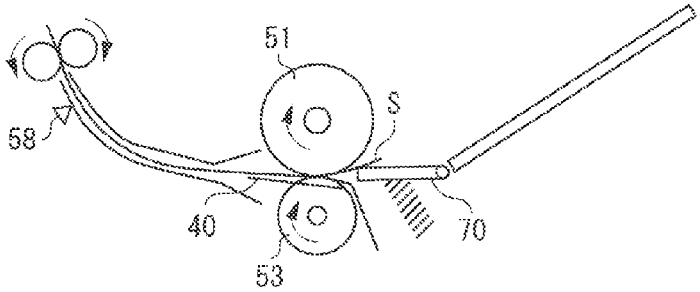
Figure 8I:
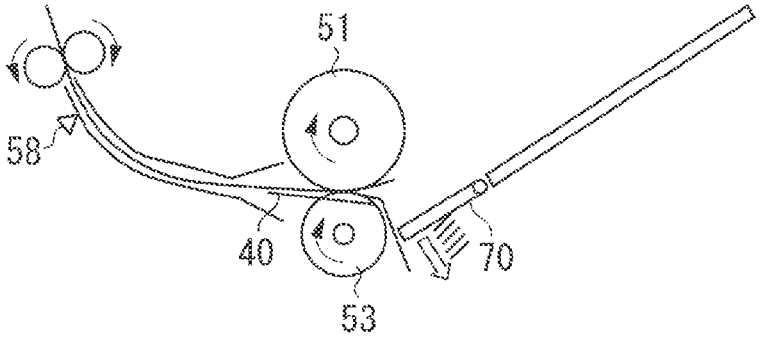
Figure 8J:
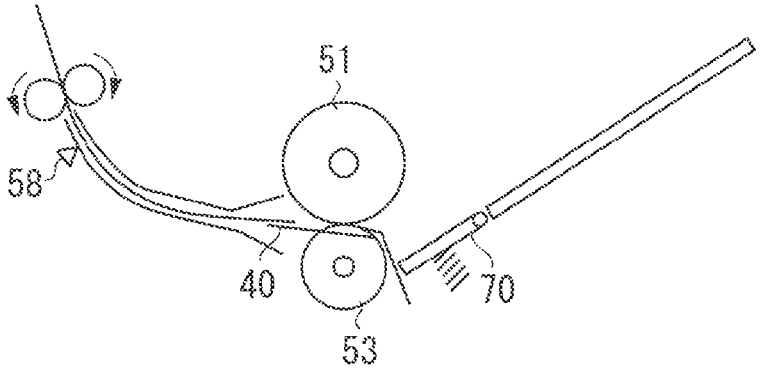

When a predetermined period of time T2 [sec] has elapsed after the resuming of the feeding of the sheet S (YES in step S10), in step S11, the registration motor M2 is rotated as illustrated in FIG. 8H. Then, the conveyance of the sheet S by the registration roller pair 57 is started. Further, after the conveyance of a predetermined amount of the sheet S, the middle plate 70 is lowered as illustrated in FIG. 8I through the one-rotation control of the cam 63*a*, and the press contact of the sheet S with the sheet feeding roller 51 due to the middle plate 70 is released. As a result, double feeding, in which a sheet being fed takes out the next sheet by frictional force generated therebetween, is prevented.

When a predetermined time T3 [sec] has elapsed since the re-feeding of the sheet S (YES in step S12), in step S13, the electromagnetic clutch CL1 is turned off at the timing in which the trailing edge of the sheet S passes the nip portion N of the sheet feeding roller 51 and the separation roller 53. As a result, the transmission of the driving force from the sheet feeding motor M1 to the sheet feeding roller 51 and the separation roller 53 is released.

When the sheet S conveyed by the registration roller pair 57 passes through the pre-registration sensor 58, the pre-registration sensor 58 is turned off (YES in step S14). Then, the processing proceeds to step S15. When a predetermined time T4 [sec] has elapsed (YES in step S15), Then, the trailing edge of the sheet S passes the nip portion of the registration roller pair 57. Therefore, in step S16, the registration motor M2 is stopped to stop the registration roller pair 57. Thereafter, in step S17, a similar operation is repeated until the operation for a predetermined number of sheets has been completed. When the operation for the predetermined number of sheets has been completed (YES in step S17), in step S18, the sheet feeding motor M1 is stopped, and the sheet feeding operation is completed.

In the state as illustrated in FIG. 8F, the sheet S is applied the retaining force generated by the nip portion of the sheet feeding roller 51 and the middle plate 70, and the abutment force with which the sheet S abuts against the nip portion of the registration roller pair 57. As a result, a warp is formed in a sheet S to enter the guide space 59*b*. When a warp is formed in the sheet S as described above, the separation roller 53 tends to be pressed down away from the sheet feeding roller 51 (as indicated by the arrow A illustrated in FIGS. 8F and 8G) due to the rigidity of the sheet S.

However, as described above, between the sheet feeding roller 51 and the separation roller 53, the backup sheet 40 is arranged so as to cover the guide space 59*b* from the upstream to the downstream side of the nip portion. With the arrangement of the backup sheet 40 at the position, when the sheet S tends to form a warp so as to enter the guide space 59*b*, the backup sheet 40 abuts against the sheet S in the vicinity of the downstream side in the sheet feeding direction of the nip portion N from the separation roller 53 side.

At this time, the sheet S is caused to form a warp while deforming the backup sheet 40 downwardly. However, the force pushing back the sheet S in the direction of the sheet feeding roller 51 (as indicated by the arrow B illustrated in FIGS. 8F and 8G) is applied to the sheet from the backup sheet 40. The force due to the backup sheet 40 pushing back the sheet S is applied in the direction opposite to the direction of the force pressing down the separation roller 53 away from the sheet feeding roller 51. Therefore, it is possible to prevent the separation roller 53 from being separated from the sheet feeding roller 51.

By preventing the separation roller 53 from being pressed down, when conveying the sheet S toward the nip portion of the stopped registration roller pair 57, it is possible to obtain the requisite conveyance force for causing the sheet S to abut against the portion between the sheet feeding roller 51 and the separation roller 53. Further, as illustrated in FIG. 8G, also when starting the rotation of the sheet feeding motor M1 and rotating the registration motor M2 thereafter, the deforming force is downwardly applied to the backup sheet 40 due to the sheet S. However, in this case also, the force pushing back the sheet S in the direction of the sheet feeding roller 51 is applied to the sheet S by the backup sheet 40. As a result, it is possible to prevent the separation roller 53 from being pressed down away from the sheet feeding roller 51 due to the rigidity of the sheet S.

As described above, according to the present exemplary embodiment, the backup sheet 40 abuts against the warped sheet in the vicinity of the downstream side in the sheet feeding direction of the nip portion N of the sheet feeding roller 51 and the separation roller 53 from the separation roller 53 side. Then, the backup sheet 40 is deformed toward the separation roller 53 side. By deforming the backup sheet 40 as described above, the force pressing down the separation roller 53 away from the sheet feeding roller 51 due to the rigidity of the warped sheet S is reduced. Therefore, the requisite conveyance force can be obtained also for a sheet of high rigidity, such as an envelope or a postcard. Further, the backup sheet 40 is provided in such a manner that the upstream side thereof in the sheet feeding direction is inclined toward the separation roller 53 side. Therefore, the feeding back effect on double-fed sheets is not affected.

Figure 9A:
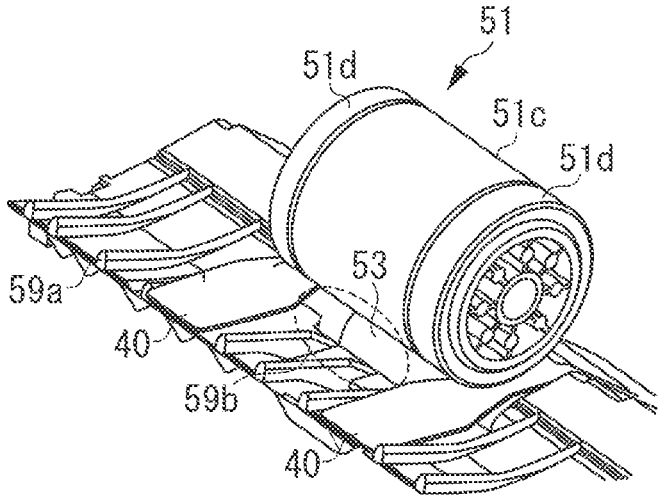
FIGS. 9A and 9B are diagrams each illustrating another configuration of the above manual sheet feeding unit.
Figure 9B:
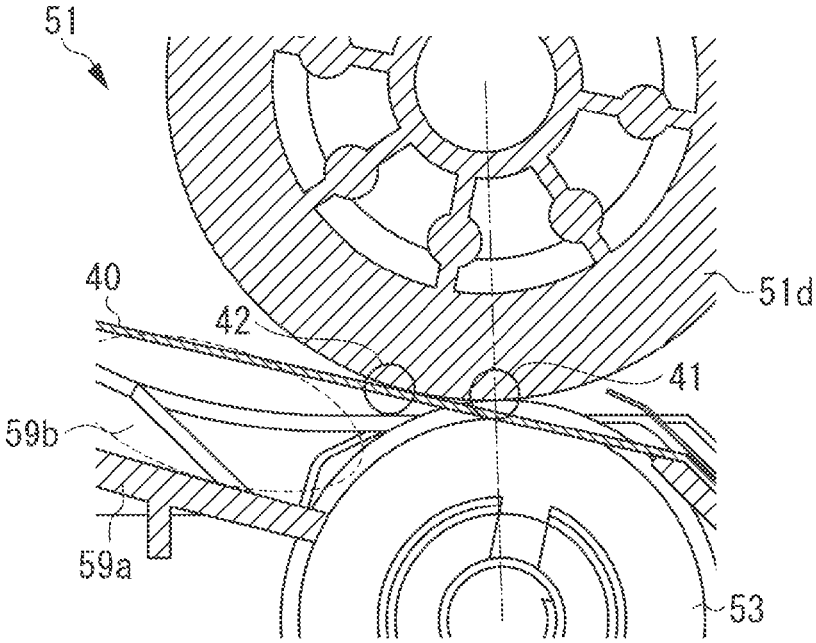
Figure 10:
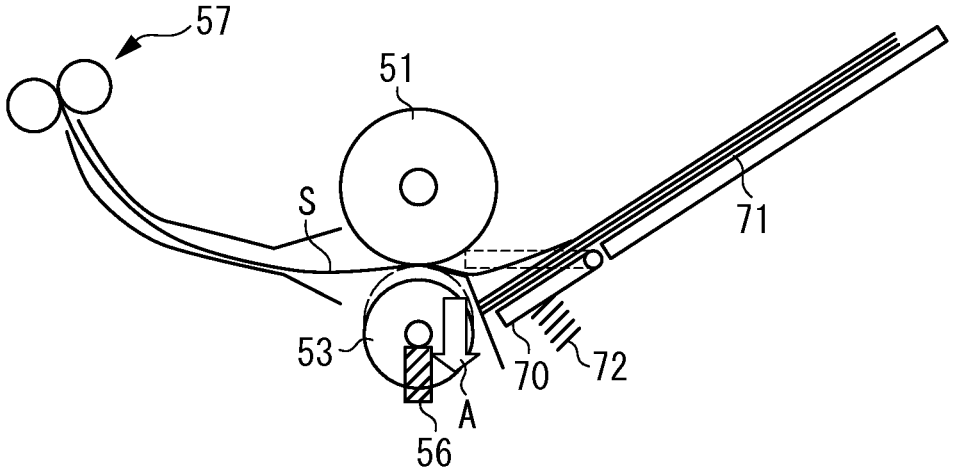
FIG. 10 Prior Art
FIG. 10 is a diagram illustrating a configuration of a conventional sheet feeding apparatus.

While, according to the present exemplary embodiment, the backup sheet 40 and the sheet feeding roller 51 are arranged so as not to be in contact with each other on the downstream side of the nip portion N, this should not be construed restrictively. For example, as illustrated in FIG. 9A, sliding members 51*d* may be provided on both sides of a rubber roller portion 51*c* of the sheet feeding roller 51, and, as illustrated in FIG. 9B, sliding members 51*d* may be brought into contact with the backup sheet 40. Further, according to the present exemplary embodiment, the backup sheet 40 is arranged on both side of the single sheet feeding roller 51. Alternatively, a single backup sheet may be arranged between, for example, two sheet feeding rollers.

According to the present exemplary embodiment, the sheets S are separated by the sheet feeding roller 51 and the separation roller 53. Alternatively, the sheets S may be separated by the sheet feeding roller 51 and a separation pad. Further, according to the present exemplary embodiment, the sheet S is fed through elevation of the middle plate 70. Alternatively, the sheet S may be fed through elevation of the pickup roller.

Further, a configuration according to the present exemplary embodiment is described in which the sheet S is brought into press contact with the sheet feeding roller 51 again in response to the detection of the sheet S by the pre-registration sensor 58 to enter the nip portion N of the registration roller pair 57. However, the above-described configuration should not be construed restrictively. Alternatively, the control may be performed through timing using a timer.

Further, according to the present exemplary embodiment, the present invention is applied to the manual sheet feeding unit. However, the above-described arrangement should not be construed restrictively. The present invention is also applicable to the sheet feeding device 103 provided in the printer main body 101. Further, according to the present exemplary embodiment, the backup sheet 40 is provided so as to extend from the upstream to the downstream side of the nip portion N of the sheet feeding roller 51 and the separation roller 53. However, the warp in the sheet S to the separation roller 53 side can be prevented from occurring by providing the backup sheet 40 at least on the downstream side of the nip portion N.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-076814 filed Apr. 2, 2013, which is hereby incorporated by reference herein in its entirety.

What is claimed is:

1. An image forming apparatus comprising:

an image forming unit configured to form an image on a sheet;

a sheet stacking unit on which sheets are stacked;

a sheet feeding unit configured to feed the sheets stacked on the sheet stacking unit;

a separation unit held in press contact with the sheet feeding unit and configured to separate the sheets fed from the sheet feeding unit;

a registration unit, which is arranged on a downstream in a sheet feeding direction with respect to a press contact portion where the sheet feeding unit and the separation unit are held in press contact with each other, configured to abut, while being at rest, against the leading edge of the sheet which is conveyed while being nipped by the sheet feeding unit and the separation unit, and to convey the sheet to the image forming unit by rotating at a predetermined timing; and an elastic member provided so as to extend from an upstream to a downstream with respect to the press contact portion in the sheet feeding direction and to be positioned at the separation unit side with respect to a tangential line of the press contact portion, which is formed in a plate shape capable of elastic deformation and configured to abut against the sheet, wherein the elastic member is inclined so that an upstream side in the sheet feeding direction thereof is positioned at the separation unit side with respect to the tangential line and a downstream side in the sheet feeding direction thereof is positioned at the sheet feeding unit side with respect to the tangential line.

2. The image forming apparatus according to claim 1, further comprising a curved sheet conveyance path, which is provided on the downstream in the sheet feeding direction with respect to the press contact portion, configured to guide the sheet to the registration unit.

3. The image forming apparatus according to claim 1, wherein a width in a width direction orthogonal to the sheet feeding direction of a portion of the elastic member on the downstream side in the sheet feeding direction with respect to the press contact portion is larger than a width of a portion of the elastic member on the upstream side in the sheet feeding direction with respect to the press contact portion.

4. The image forming apparatus according to claim 1, further comprising:

a pressure member, which is elevatably provided on the sheet stacking unit, configured to move to a position where the sheet is held in press contact with the sheet feeding unit and to a position where the press contact of the sheet and the sheet feeding unit is released; and a moving unit configured to move the pressure member to the position where the press contact of the sheet and the sheet feeding unit is released after the sheet has entered the press contact portion, and to move the pressure member to the position where the sheet and the sheet feeding unit are held in press contact with each other when causing the sheet to enter the registration unit.

5. The image forming apparatus according to claim 4, further comprising a detection unit configured to detect the sheet on the upstream in the sheet feeding direction with respect to the registration unit, and wherein, based on a sheet detection signal from the detection unit, the pressure member is moved by the moving unit to the position where the sheet and the sheet feeding unit are held in press contact with each other.

6. The image forming apparatus according to claim 1, wherein a distance between the elastic member and the press contact portion is longer in a direction perpendicular to the tangent line than a distance between a downstream side portion of the elastic member close to the press contact portion and the sheet feeding unit.

7. The image forming apparatus according to claim 1, wherein the elastic member is arranged on both sides of the press contact portion formed by the sheet feeding unit and the separation unit.

8. The image forming apparatus according to claim 1, wherein the sheet feeding unit includes a sheet feeding roller, and wherein the separation unit includes a separation roller and a pressure spring to press the separation roller against the sheet feeding roller to form the press contact portion.

9. An image forming apparatus comprising:

an image forming unit configured to form an image on a sheet;

a sheet stacking unit on which sheets are stacked;

a sheet feeding roller configured to feed the sheets stacked on the sheet stacking unit;

a separation unit held in press contact with the sheet feeding roller and having an axial length smaller than the sheet feeding roller;

a registration unit, against which a leading edge of the sheet abuts, the sheet being conveyed while being nipped at a press contact portion between the sheet feeding roller and the separation unit, configured to start conveyance with a predetermined timing; and an elastic member which is formed in a plate shape capable of elastic deformation arranged on both sides of the press contact portion between the sheet feeding roller and the separation unit, extending from an upstream to a downstream in a sheet feeding direction, wherein the elastic member is positioned at the separation unit side with respect to a tangential line of the press contact portion and is inclined so that an upstream side in the sheet feeding direction thereof is positioned at the separation unit side with respect to the tangential line and a downstream side in the sheet feeding direction thereof is positioned at the sheet feeding roller side with respect to the tangential line.

10. The image forming apparatus according to claim 9, further comprising a curved sheet conveyance path arranged between the sheet feeding roller and the separation unit, and the registration unit, configured to guide the sheet to the registration unit.

11. The image forming apparatus according to claim 9, wherein a width in a width direction orthogonal to the sheet feeding direction of a portion of the elastic member on the downstream side in the sheet feeding direction with respect to the press contact portion is larger than a width in a width direction of a portion of the elastic member on the upstream side in the sheet feeding direction with respect to the press contact portion.

12. The image forming apparatus according to claim 9, wherein the sheet stacking unit is provided on a side surface of an apparatus main body so as to be capable of being opened and closed, and is opened to a position where stacking of sheets is possible when a sheet is to be fed.

13. The image forming apparatus according to claim 9, wherein a distance between the elastic member and the press contact portion is longer in a direction perpendicular to the tangent direction than a distance between a downstream side portion of the elastic member close to the press contact portion and the sheet feeding roller.

* * * * *